US009366067B2

(12) United States Patent
Wu

(10) Patent No.: US 9,366,067 B2
(45) Date of Patent: Jun. 14, 2016

(54) SOFT-CLOSING HINGE FOR USE IN FURNITURE

(71) Applicant: Zhiyong Wu, Guangdong (CN)

(72) Inventor: Zhiyong Wu, Guangdong (CN)

( * ) Notice: Subject to any disclaimer, the term of this patent is extended or adjusted under 35 U.S.C. 154(b) by 0 days.

(21) Appl. No.: 14/601,333

(22) Filed: Jan. 21, 2015

(65) Prior Publication Data

US 2015/0315832 A1 Nov. 5, 2015

(30) Foreign Application Priority Data

Apr. 30, 2014 (CN) ..... 2014 1 0183032

(51) Int. Cl.

*E05F 1/08* (2006.01)
*E05F 1/12* (2006.01)
*E05D 3/02* (2006.01)

(52) U.S. Cl.

CPC ..... *E05F 1/1215* (2013.01); *E05D 3/02* (2013.01); *E05F 1/1292* (2013.01); *Y10T 16/2771* (2015.01); *Y10T 16/283* (2015.01); *Y10T 16/287* (2015.01); *Y10T 16/299* (2015.01)

(58) Field of Classification Search

CPC ..... E05Y 2900/20; E05Y 2900/202; E05Y 2900/204; E05Y 2900/208; E05Y 2201/20; E05Y 2201/21; E05Y 2201/256; E05F 5/006; E05F 5/02; E05D 11/1021; E05D 11/1042; E05D 11/105; E05D 11/1064; E05D 7/04; E05D 7/0407; E05D 7/125; E05D 3/142; Y10T 16/5383; Y10T 16/304; Y10T 16/54029

See application file for complete search history.

(56) References Cited

U.S. PATENT DOCUMENTS 5,604,956 A * 2/1997 Grass ..... E05D 11/1014 16/277
5,617,612 A * 4/1997 Ferrari ..... E05D 11/1014 16/278
8,650,711 B1 * 2/2014 Chen ..... E05F 5/006 16/286
8,720,010 B2 * 5/2014 Forster ..... E05F 5/006 16/286
2005/0015927 A1 * 1/2005 Kropf ..... E05D 3/142 16/286
2012/0126677 A1 * 5/2012 Ahlfeld ..... E05F 5/006 312/326
2013/0160242 A1 * 6/2013 Brunnmayr ..... E05F 5/006 16/286
2013/0167323 A1 * 7/2013 Brunnmayr ..... E05D 11/11014 16/50
2013/0291538 A1 * 11/2013 Grossmann ..... F16K 1/2064 60/602
2014/0331451 A1 * 11/2014 Holzapfel ..... E05F 5/006 16/286
2014/0345081 A1 * 11/2014 Salice ..... E05F 5/006 16/50
2014/0352111 A1 * 12/2014 Ng ..... E05F 5/006 16/286
2014/0366322 A1 * 12/2014 Salice ..... E05F 5/006 16/277

* cited by examiner

*Primary Examiner* — Chuck Mah
(74) *Attorney, Agent, or Firm* — Pearne & Gordon LLP

(57) ABSTRACT

Soft-closing hinge for furniture comprising a movable hinge cup coupled to a door panel, a securing member coupled to a wall panel and a hinge arm configured to couple the hinge cup to the securing member. A damper on the hinge cup acts on the hinge arm at least when the hinge is closed. A spring is disposed in the hinge. One end of the hinge arm is hinged to the hinge cup. A cross section of an end of the spring is non-circular and has a sliding member with a concave chamber disposed thereon. An end of the spring is disposed in the concave chamber. A bottom surface of the sliding member acts on a rotation portion of the hinge arm via elasticity of the spring and moves relative to the rotation portion when the hinge is opened and/or closed to generate an opening or closing force.

3 Claims, 10 Drawing Sheets

SOFT-CLOSING HINGE FOR USE IN FURNITURE

TECHNICAL FIELD

The present invention relates to a hinge, and in particular, to a soft-closing hinge for use in furniture.

BACKGROUND

The Chinese Patent Application No. CN103590693A filed by the applicant of the present invention on Feb. 19, 2014 has disclosed a soft-closing hinge for use in furniture, which comprises a damper device, a hinge arm, and a metal hinge cup coupled via the hinge arm. The hinge is provided with a metal spring which at least exerts an opening or closing force to the metal hinge cup. One end of the metal spring is disposed on the metal hinge cup, and the other end of the metal spring is crimped on a rotation portion of the hinge arm. The area where the intermediate portion of the metal spring is in contact with the metal hinge cup is provided with a member made of a flexible material. When the hinge is opened and/or closed, the member made of the flexible material eliminates the noise generated by longitudinal movement of the metal spring relative to the metal hinge cup. However, the cross section of the metal spring of the hinge is circular, which may frequently cause point contact when being in contact with the member made of the flexible material, consequently shortening the service life thereof. Therefore, some improvements are desired.

SUMMARY

To address the defects in the related art, an objective of the present invention is to provide a hinge device having the advantages of reasonable structure, reliable performance, flexible operation, long service life, smooth and stable opening and closing, little force, low noise, and high practicability, which is capable of relatively moving.

In view of the above, a soft-closing hinge for use in furniture, comprises a movable hinge cup coupled to a door panel, a securing member coupled to a wall panel and a hinge arm configured to couple the movable hinge cup to the securing member, a damper being disposed on the movable hinge cup, the damper acting on the hinge arm at least when the hinge is closed, a spring for at least exerting an opening or closing force to the movable hinge cup being disposed in the hinge; wherein: one end of the hinge arm is hinged to the movable hinge cup via a coupling unit; a cross section of at least one end of the spring is of a non-circular shape and provided with a sliding member, a concave chamber being disposed on the sliding member, and at least one end of the spring is disposed in the concave chamber; and a bottom surface of the sliding member acts on a rotation portion of the hinge arm via elasticity of the spring and moves relative to the rotation portion when the hinge is opened and/or closed to generate an opening force or a closing force.

The spring is a metal torsion spring; one end of the spring is disposed in the concave chamber of the sliding member and movably crimped on the rotation portion of the hinge arm via the sliding member when the hinge is opened and/or closed; and the other end of the spring is positioned and acts on the movable hinge cup.

One end of the sliding member is provided with the concave chamber and sleeved onto one end of the spring via the concave chamber, and the other end of the sliding member is positioned and acts on an intermediate portion of the spring or on the movable hinge cup.

The cross section of one end of the spring is at least a quadrangle, an ellipse, a triangle, a trapezoid, or a polygon; and a cross section of the concave chamber of the sliding member mates with the cross section of one end of the spring in terms of shape, one end of the spring is received in the concave chamber of the sliding member, or the cross section of the concave chamber of the sliding member is circular, and one end of the spring is received in the concave chamber of the sliding member.

The sliding member is made of plastic or rubber, and the rotation portion is made of metal; and the bottom surface of the sliding member linearly acts on the rotation portion of the hinge arm when the hinge is opened and/or closed.

The bottom surface of the sliding member acting on the rotation portion is a planar surface or an arc surface, and the cross section of the sliding member is at least partially linear.

One end of the sliding member is provided with the concave chamber and sleeved onto one end of the spring via the concave chamber, and the other end of the sliding member is provided with a buckle unit and is positioned on a chamber body in the intermediate portion of the spring via the buckle unit.

The movable hinge cup is made of metal, the sliding member is positioned on the spring via the buckle unit, the sliding member is further provided with an action portion and acts on the intermediate portion of the spring via the action portion, and the intermediate portion of the spring is pressed against the movable hinge cup via the action portion to eliminate the force applied by the intermediate portion of the spring onto the movable hinge cup and noise generated by longitudinal movement of the spring relative to the movable hinge cup.

The damper is a self-resetting oil damper or a self-resetting gas damper, and positioned on the movable hinge cup via a cover.

The cover is disposed on the damper and provided with a damper switch member in a rotation or swinging manner, and a buffer stroke of the damper is restricted or restored by rotating or swing the damper switch member when the hinge is opened and/or closed.

According to the present invention, with the above improvements to the structure, a cross section of at least one end of the spring is of a non-circular shape and provided with a sliding member, a concave chamber is disposed on the sliding member, at least one end of the spring is received in the concave chamber, and a bottom surface of the sliding member acts on a rotation portion of the hinge arm via elasticity of the spring and moves relative to the rotation portion when the hinge is opened and/or closed to generate an opening force or a closing force. The bottom surface is a planar surface or an arc surface, and the cross section of the sliding member is at least partially linear, such that contact between the spring, the sliding member, and the hinge arm changes from point contact to linear contact. This enlarges the contact surface therebetween, and renders a more uniform force bearing surface and a more dispersed elastic force. In this way, mutual friction between the spring, the sliding member, and the hinge arm and loss thereof are reduced when the hinge is opened and/or closed, thereby prolonging the service life of the hinge. The intermediate portion of the spring is pressed against the movable hinge cup via the action portion of the sliding member to reduce the noise generated by friction between the spring and the movable hinge cup, such that the opening and closing of the hinge is smoother and the noise is lower. This enhances the user experience. In addition, a damper switch member capable of restricting the buffer stroke of the damper is disposed on the cover. When the hinge is opened, a user can rotate or swing the damp switch member manually or by using a tool to its locking position. The hinge is gradually closed, and the hinge arm acts on the damper, such that the buffer stroke of the damper is gradually reduced. In this case, the locking position of the damper is locked with the locking portion of the damper switch member, such that the buffer stroke of the damper is restricted within a specific range. Then the damper switch member is rotated or swung to its releasing position, such that the buffer stroke of the damper is restored, thereby effectively prolonging the service life of the damper. In addition, the user can adjust the buffer stroke of the buffer according to actual needs, to control the speed and force of closing the hinge, mitigate the collision between parts of the furniture, and reduce the noise. According to the present invention, the hinge has the advantages of reasonable structure, reliable performance, flexible operation, long service life, smooth and stable opening and closing, little force, low noise, and high practicability.

DETAILED DESCRIPTION

Figure 1:
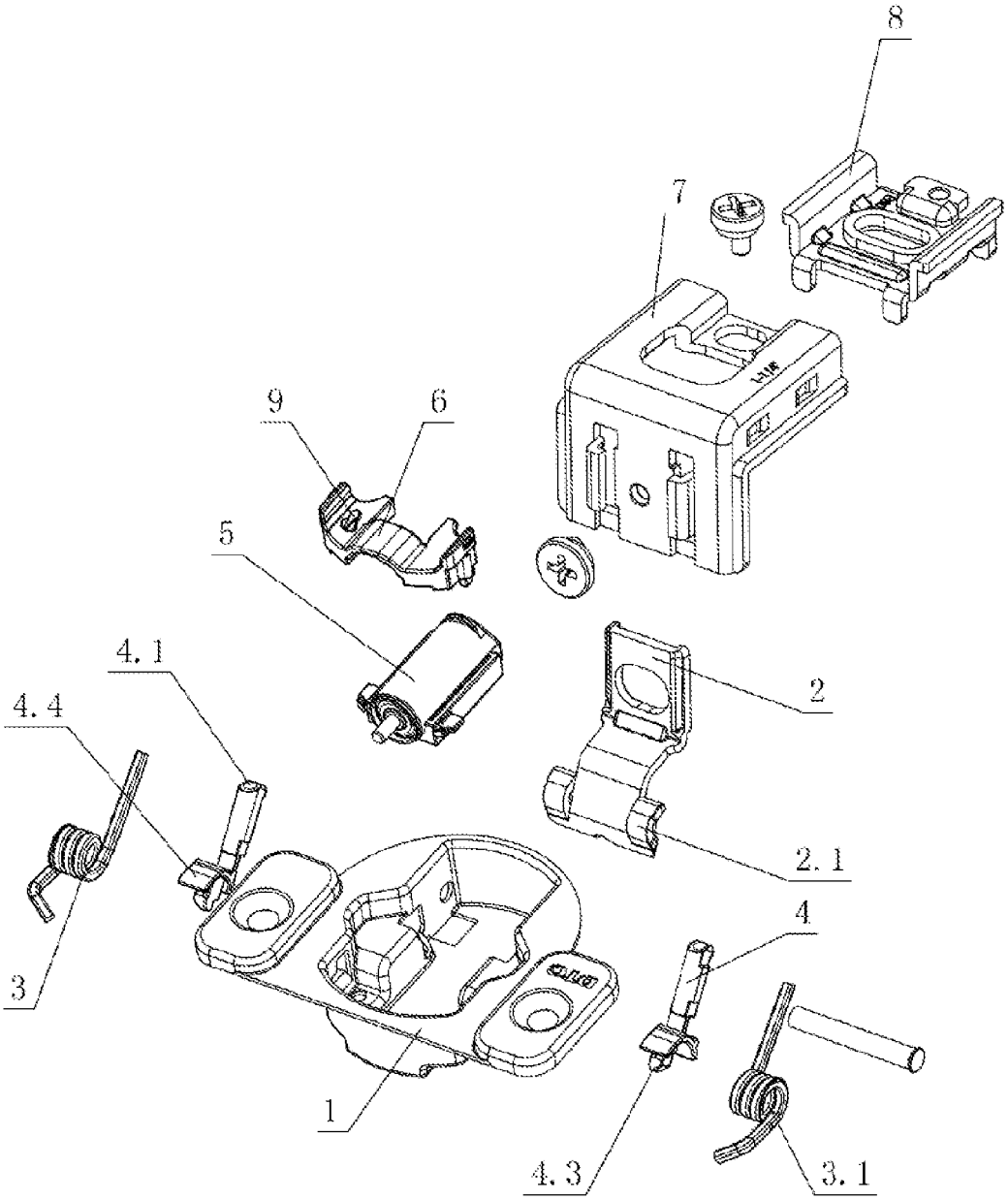
FIG. 1 is an exploded schematic structural view of a first embodiment of the present invention.
Figure 2:
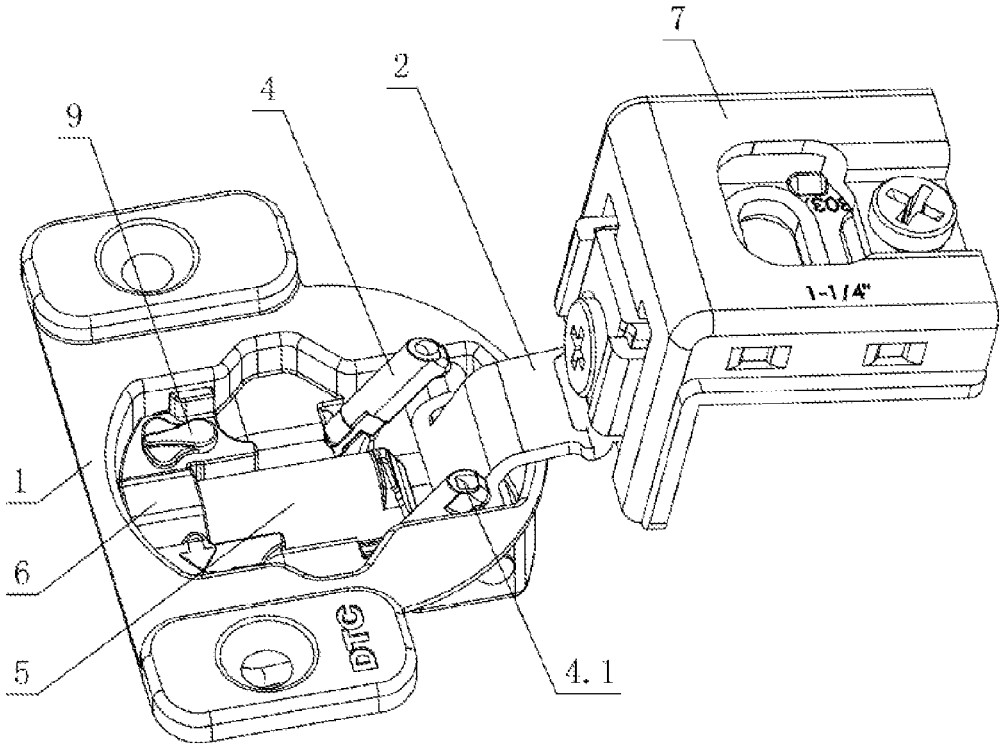
FIG. 2 and FIG. 3 are schematic structural views of a first embodiment of the present invention.
Figure 3:
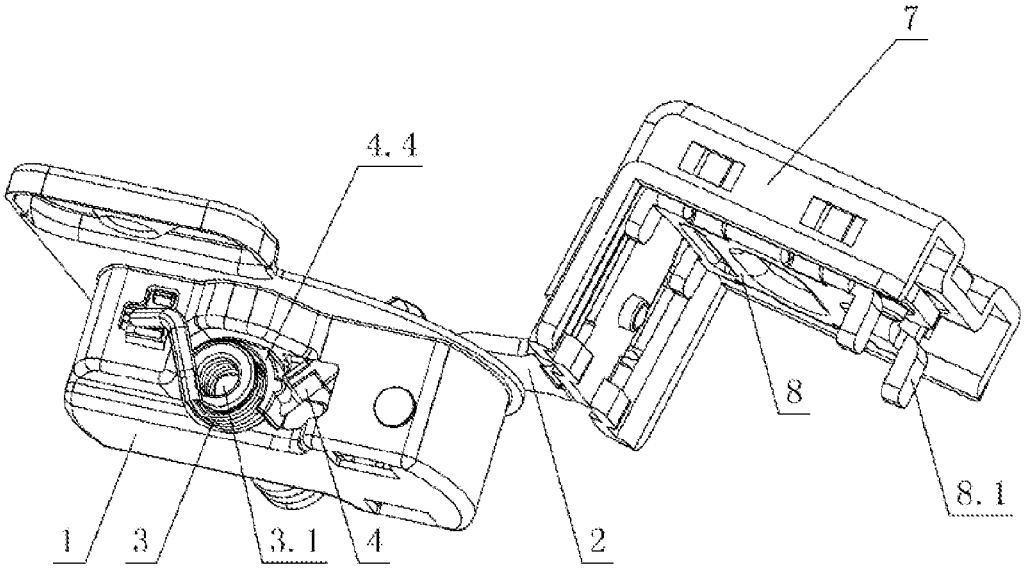
Figure 4:
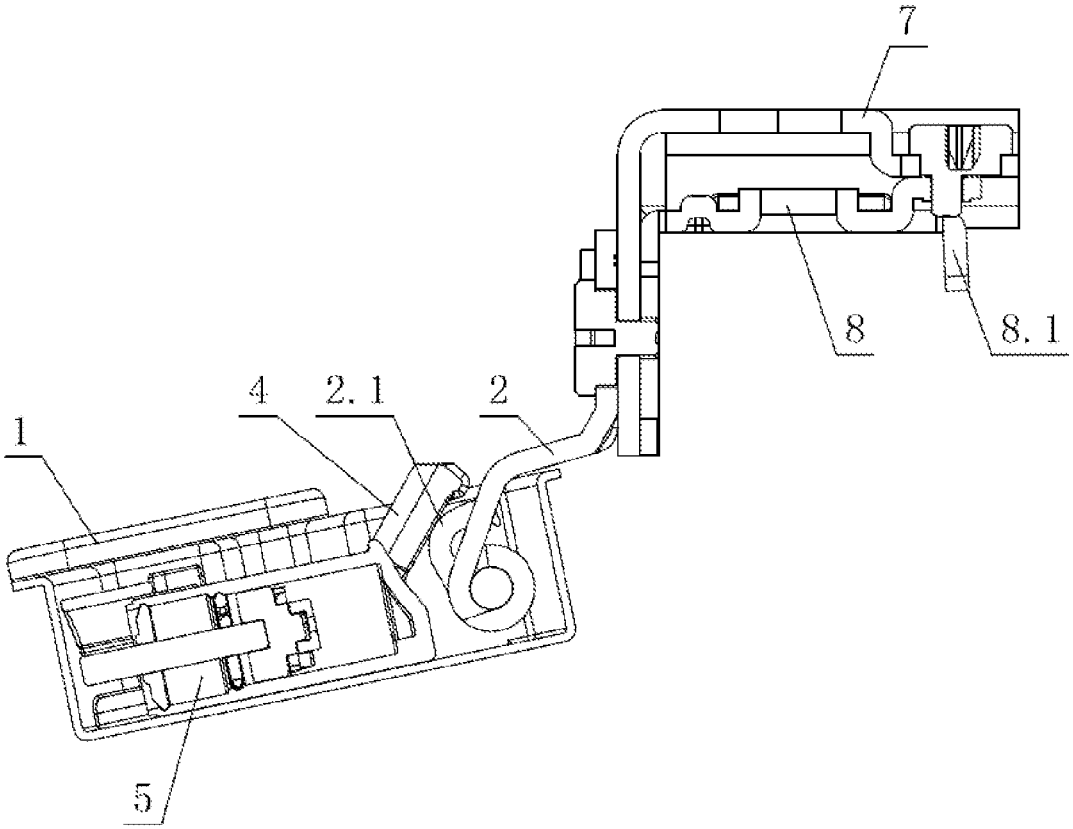
FIG. 4 is a schematic structural view (sectional view) when a hinge is opened according to the present invention.
Figure 5:
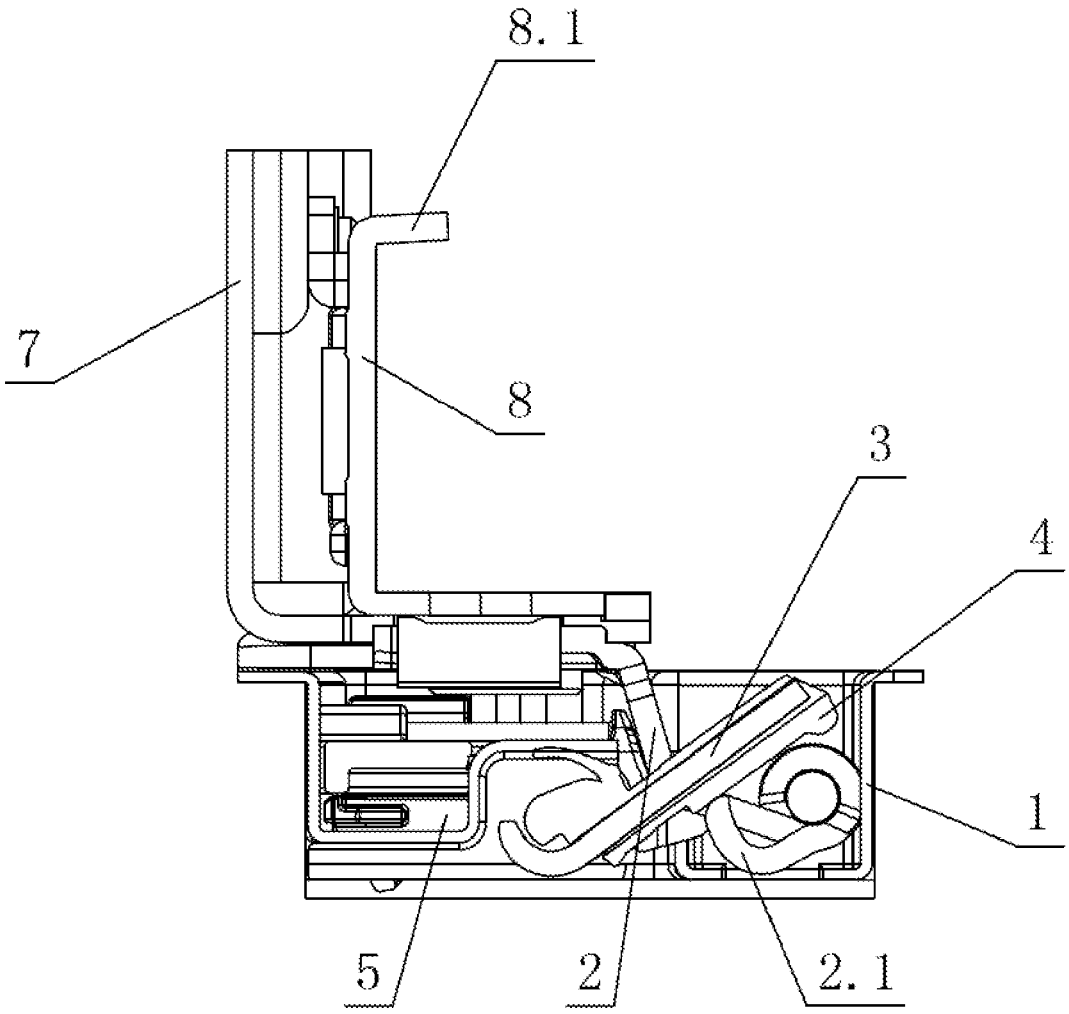
FIG. 5 is a schematic structural view (sectional view) when the hinge is closed according to the present invention.
Figure 6:
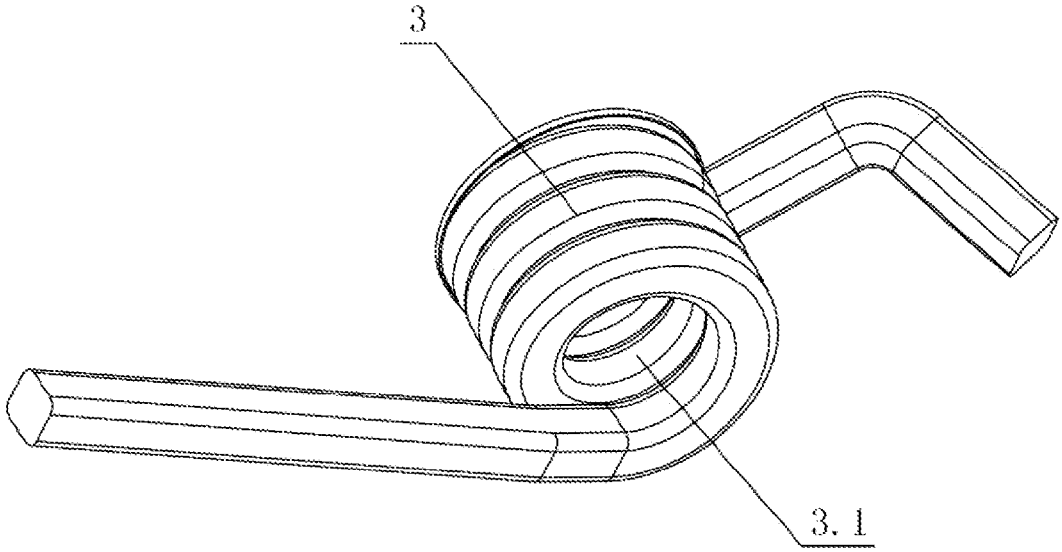
FIG. 6 is a schematic structural view of a spring according to the present invention.
Figure 7:
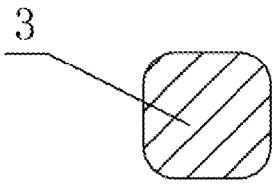
FIG. 7 to FIG. 11 are schematic structural views (sectional views) of a plurality of application examples of a spring according to the present invention.
Figure 8:
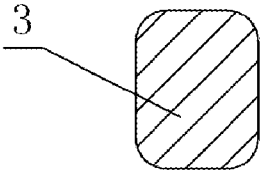
Figure 9:
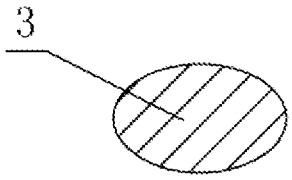
Figure 10:
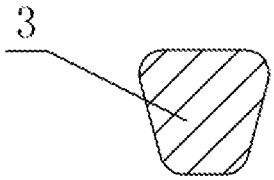
Figure 11:
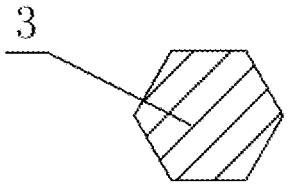
Figure 12:
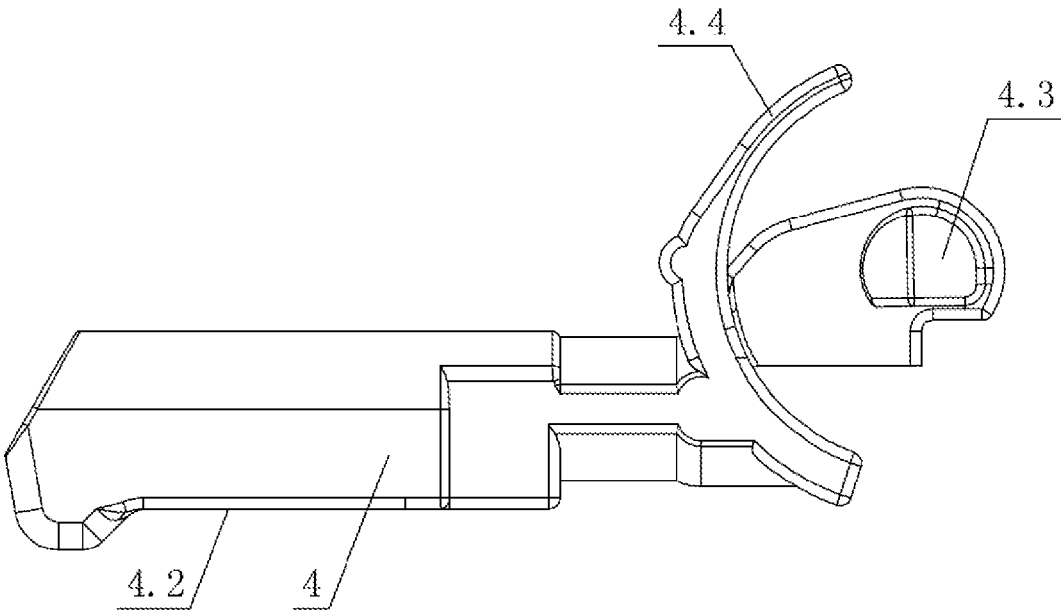
FIG. 12 is a schematic structural view of a sliding member according to the present invention.
Figure 13:
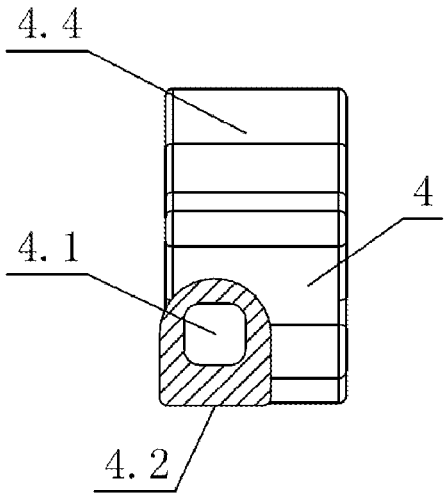
FIG. 13 to FIG. 17 are schematic structural views (sectional views) of a plurality of application examples of a sliding member according to the present invention.
Figure 14:
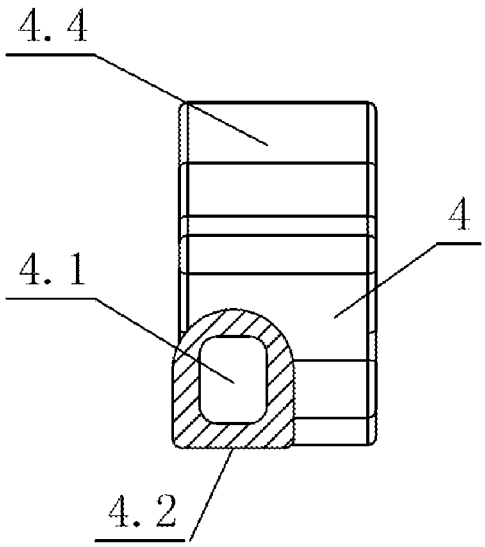
Figure 15:
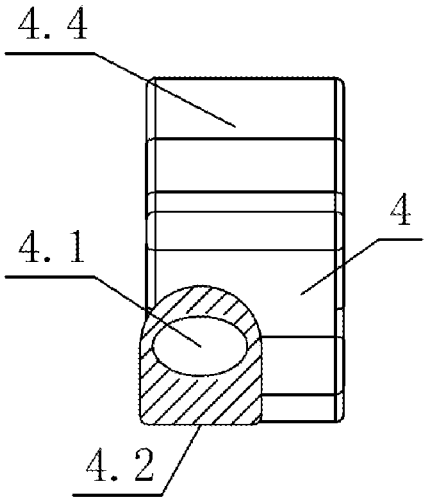
Figure 16:
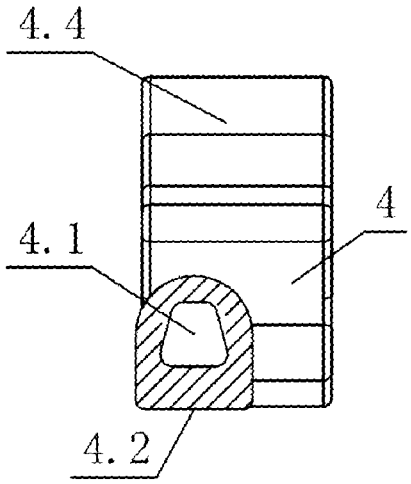
Figure 17:
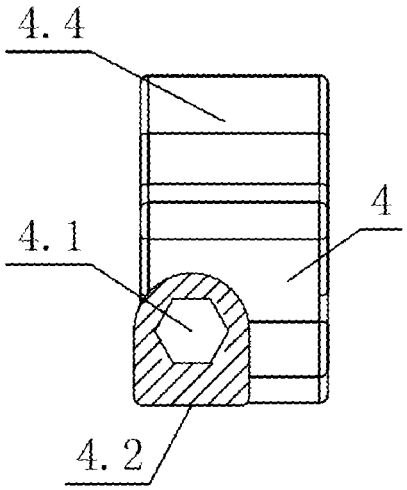

The present invention is further described with reference to the accompanying drawings and exemplary embodiments.

First Embodiment

Referring to FIG. 1 to FIG. 5, a soft-closing hinge for use in furniture, comprises a movable hinge cup 1 coupled to a door panel, a securing member 8 coupled to a wall panel and a hinge arm 2 configured to couple the movable hinge cup 1 to the securing member 8, a damper 5 being disposed on the movable hinge cup 1, the damper 5 acting on the hinge arm 2 at least when the hinge is closed, a spring 3 for at least exerting an opening or closing force to the movable hinge cup 1 being disposed in the hinge; wherein: one end of the hinge arm 2 is hinged to the movable hinge cup 1 via a coupling unit; a cross section of at least one end of the spring 3 is of a non-circular shape and provided with a sliding member 4, a concave chamber 4.1 being disposed on the sliding member 4, and at least one end of the spring 3 is disposed in the concave chamber 4.1; and a bottom surface 4.2 of the sliding member 4 acts on a rotation portion 2.1 of the hinge arm 2 via elasticity of the spring 3 and moves relative to the rotation portion 2.1 when the hinge is opened and/or closed to generate an opening force or a closing force.

The spring 3 is a metal torsion spring; one end of the spring 3 is disposed in the concave chamber 4.1 of the sliding member 4 and movably crimped on the rotation portion 2.1 of the hinge arm 2 via the sliding member 4 when the hinge is opened and/or closed; and the other end of the spring 3 is positioned and acts on the movable hinge cup 1. One end of the sliding member 4 is provided with the concave chamber 4.1 and sleeved onto one end of the spring 3 via the concave chamber 4.1, and the other end of the sliding member 4 is positioned and acts on an intermediate portion of the spring 3 or on the movable hinge cup 1.

Specifically, referring to FIG. 6 to FIG. 17, the cross section of one end of the spring 3 is at least a quadrangle, an ellipse, a triangle, a trapezoid, or a polygon; and a cross section of the concave chamber 4.1 of the sliding member 4 mates with the cross section of one end of the spring 3 in terms of shape, and one end of the spring 3 is received in the concave chamber 4.1 of the sliding member 4. In addition, the cross section of the concave chamber 4.1 of the sliding member 4 may also be circular, and one end of the spring 3 is received in the concave chamber 4.1 of the sliding member 4.

In this embodiment, the cross section of the spring 3 is preferably a square, the cross section of the concave chamber 4.1 of the sliding member 4 is correspondingly a square, such that there is an even larger contact area therebetween, the force bearing surface is more uniform, and the elastic force is more dispersed, thereby prolonging the service life of the hinge.

The sliding member 4 is made of plastic or rubber, and the rotation portion 2.1 is made of metal; and the bottom surface 4.2 of the sliding member 4 linearly acts on the rotation portion 2.1 of the hinge arm 2 when the hinge is opened and/or closed.

The bottom surface 4.2 of the sliding member 4 acting on the rotation portion 2.1 is a planar surface or an arc surface, and the cross section of the sliding member is at least partially linear.

One end of the sliding member 4 is provided with the concave chamber 4.1 and sleeved onto one end of the spring 3 via the concave chamber 4.1, and the other end of the sliding member 4 is provided with a buckle unit 4.3 and is positioned on a chamber body 3.1 in the intermediate portion of the spring 3 via the buckle unit 4.3. The movable hinge cup 1 is made of metal, the sliding member 4 is positioned on the spring 3 via the buckle unit 4.3, the sliding member 4 is further provided with an action portion 4.4 and acts on the intermediate portion of the spring 3 via the action portion 4.4, and the intermediate portion of the spring 3 is pressed against the movable hinge cup 1 via the action portion 4.4 to eliminate the force applied by the intermediate portion of the spring 3 onto the movable hinge cup 1 and noise generated by longitudinal movement of the spring 3 relative to the movable hinge cup 1.

In the above-described structure, the damper 5 is a self-resetting oil damper or a self-resetting gas damper, and positioned on the movable hinge cup 1 via a cover 6. The cover 6 is disposed on the damper 5 and provided with a damper switch member 9 in a rotation or swinging manner, and a buffer stroke of the damper 5 is restricted or restored by rotating or swing the damper switch member 9 when the hinge is opened and/or closed.

One end of the hinge arm 2 is hinged to the movable hinge cup 1 via a pin axle, and the other end of the hinge arm 2 is regulatably coupled to a regulating cover plate 7 via an offcenter rivet, wherein the securing member 8 is disposed on the regulating cover plate 7, and a plurality of positioning portions 8.1 are disposed on the securing member 8. The securing member 8 is positioned on the wall panel via the positioning portions 8.1.

Second Embodiment

Figure 18:
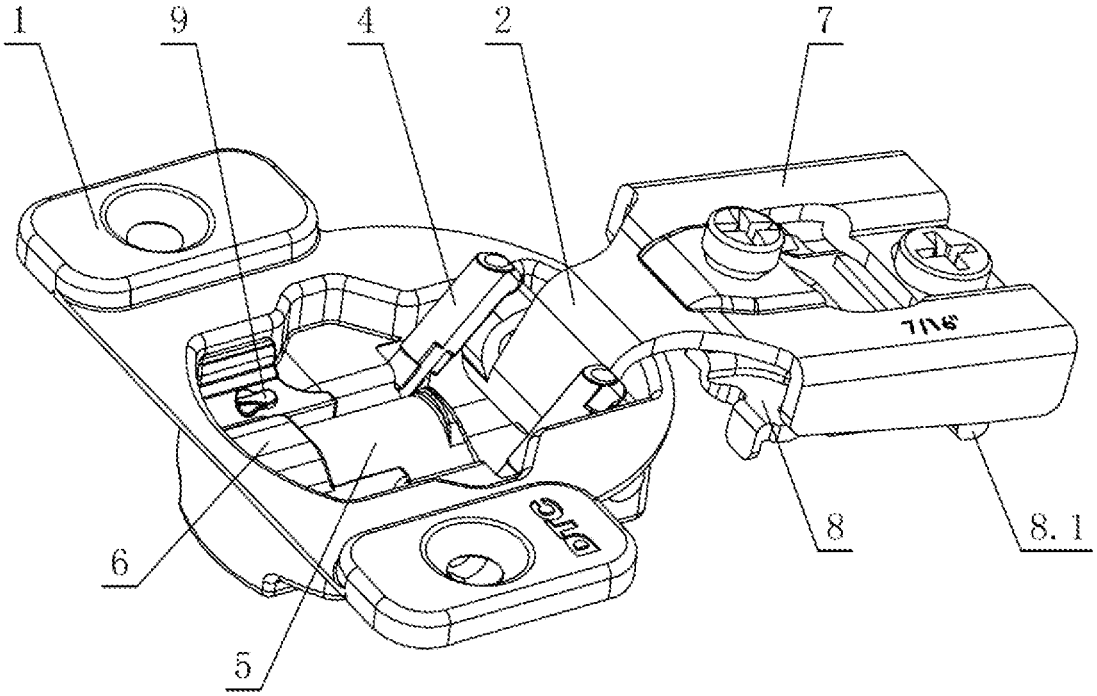
FIG. 18 is a schematic structural view of a second embodiment of the present invention.

Referring to FIG. 18, the soft-closing hinge for use in furniture is different from that described in the first embodiment in that: The hinge arm 2 is integral with the regulating cover plate 7.

For those not described herein, reference may be made to the first embodiment.

Described above are preferred solutions of the present invention. All simple variations or modifications made to the preferred solutions by persons of ordinary skill in the art shall be construed as falling within the protection scope of the present invention.

What is claimed is:

1. A soft-closing hinge for use in furniture, comprising a movable hinge cup (1) coupled to a door panel, a securing member (8) coupled to a wall panel and a hinge arm (2) configured to couple the movable hinge cup (1) to the securing member (8), a damper (5) being disposed on the movable hinge cup (1), the damper (5) acting on the hinge arm (2) at least when the hinge is closed, a spring (3) coupled to the movable hinge cup (1) for at least exerting an opening or closing force to the movable hinge cup (1) being disposed in the hinge; wherein: one end of the hinge arm (2) is hinged to the movable hinge cup (1) via a coupling unit; a cross section of at least one end of the spring (3) is of a non-circular shape and provided with a sliding member (4), a concave chamber (4.1) being disposed on the sliding member (4), and at least one end of the spring (3) is disposed in the concave chamber (4.1); and a bottom surface (4.2) of the sliding member (4) acts on a rotation portion (2.1) of the hinge arm (2) via elasticity of the spring (3) and moves relative to the rotation portion (2.1) when the hinge is opened and/or closed to generate an opening force or a closing force, wherein:

the spring (3) is a metal torsion spring, and one end of the spring (3) is disposed in the concave chamber (4.1) of the sliding member (4) and movably crimped on the rotation portion (2.1) of the hinge arm (2) via the sliding member (4) when the hinge is opened and/or closed; and the other end of the spring (3) is positioned and acts on the movable hinge cup (1), one end of the sliding member (4) is provided with the concave chamber (4.1) and sleeved onto one end of the spring (3) via the concave chamber (4.1), and the other end of the sliding member (4) is positioned and acts on an intermediate portion of the spring (3) or on the movable hinge cup (1), is provided with a buckle unit (4.3), and is further positioned on a chamber body (3.1) in the intermediate portion of the spring (3) via the buckle unit (4.3), the cross section of one end of the spring (3) is at least a quadrangle, an ellipse, a triangle, a trapezoid, or a polygon; a cross section of the concave chamber (4.1) of the sliding member (4) mates with the cross section of one end of the spring (3) in terms of shape, and one end of the spring (3) is received in the concave chamber (4.1) of the sliding member (4); or the cross section of the concave chamber (4.1) of the sliding member (4) is circular, and one end of the spring (3) is received in the concave chamber (4.1) of the sliding member (4), the sliding member (4) is made of plastic or rubber, and the rotation portion (2.1) is made of metal; and the bottom surface (4.2) of the sliding member (4) linearly acts on the rotation portion (2.1) of the hinge arm (2) when the hinge is opened and/or closed, the bottom surface (4.2) of the sliding member (4) acting on the rotation portion (2.1) is a planar surface or an arc surface, and a portion of the sliding member (4) has a cross sectional shape that is at least partially linear, and the movable hinge cup (1) is made of metal, the sliding member (4) is positioned on the spring (3) via the buckle unit (4.3), the sliding member (4) is further provided with an action portion (4.4) and acts on the intermediate portion of the spring (3) via the action portion (4.4), and the intermediate portion of the spring (3) is pressed against the movable hinge cup (1) via the action portion (4.4) to eliminate the force applied by the intermediate portion of the spring (3) onto the movable hinge cup (1) and noise generated by longitudinal movement of the spring (3) relative to the movable hinge cup (1).

2. The soft-closing hinge for use in furniture according to claim 1, wherein the damper (5) is a self-resetting oil damper or a self-resetting gas damper, and positioned on the movable hinge cup (1) via a cover (6).

3. The soft-closing hinge for use in furniture according to claim 2, wherein the cover (6) is disposed on the damper (5) and provided with a damper switch member (9) in a rotation or swinging manner, and a buffer stroke of the damper (5) is restricted or restored by rotating or swing the damper switch member (9) when the hinge is opened and/or closed.

* * * * *